US005133130A

United States Patent [19]

Podolsky

[11] Patent Number: 5,133,130

[45] Date of Patent: Jul. 28, 1992

[54] SHAVING DEVICE

[76] Inventor: Gregory Podolsky, 35-53 82 St. 3H, Jackson Hts., N.Y. 11372

[21] Appl. No.: 630,316

[22] Filed: Dec. 17, 1990

[51] Int. Cl.[5] ..... B26B 19/44

[52] U.S. Cl. ..... 30/41; 30/86; 30/90; 30/123.3

[58] Field of Search ..... 30/41, 41.5, 86, 90, 30/123.3

[56] References Cited

U.S. PATENT DOCUMENTS

| | | | |
|---|---|---|---|
| 1,453,014 | 4/1923 | Kohn | 30/41 |
| 1,650,459 | 11/1927 | Miele | 30/41 |
| 1,892,836 | 1/1933 | Harvey | 30/41 |
| 2,677,883 | 5/1954 | Schallgruber | 30/41 |
| 2,940,641 | 6/1960 | Norrish et al. | 30/41 |
| 3,364,068 | 1/1968 | Stern | 30/41 |
| 3,417,468 | 12/1968 | Miyauchi | 30/41 |
| 4,023,269 | 5/1977 | Lopez, Jr. | 30/41 |
| 4,074,429 | 2/1978 | Roberts | 30/41 |
| 4,077,119 | 3/1979 | Sellera | 30/41 |
| 4,129,942 | 12/1978 | Denizman | 30/41 |
| 4,625,402 | 12/1986 | Kavoussi | 30/41 |
| 4,653,188 | 3/1987 | Kwak | 30/41 |
| 4,791,723 | 12/1988 | Jacobson | 30/41 |
| 4,809,432 | 3/1989 | Schauble | 30/41 |
| 4,813,138 | 3/1989 | Chen | 30/41 |
| 5,016,351 | 5/1991 | Drahus | 30/41 |

*Primary Examiner*—Douglas D. Watts
*Assistant Examiner*—Hwei-Siu Payer
*Attorney, Agent, or Firm*—Ilya Zborovsky

[57] ABSTRACT

A shaving device has a handle with an inner chamber for accommodating a shaving cream, a one-piece integral head connected with the handle and having a passage for supplying the shaving cream and massaging elements, brushes on the head for distributing the shaving cream discharged from the head over the skin of the user, and a shaving element on the head for shaving after the application of the shaving cream.

10 Claims, 3 Drawing Sheets

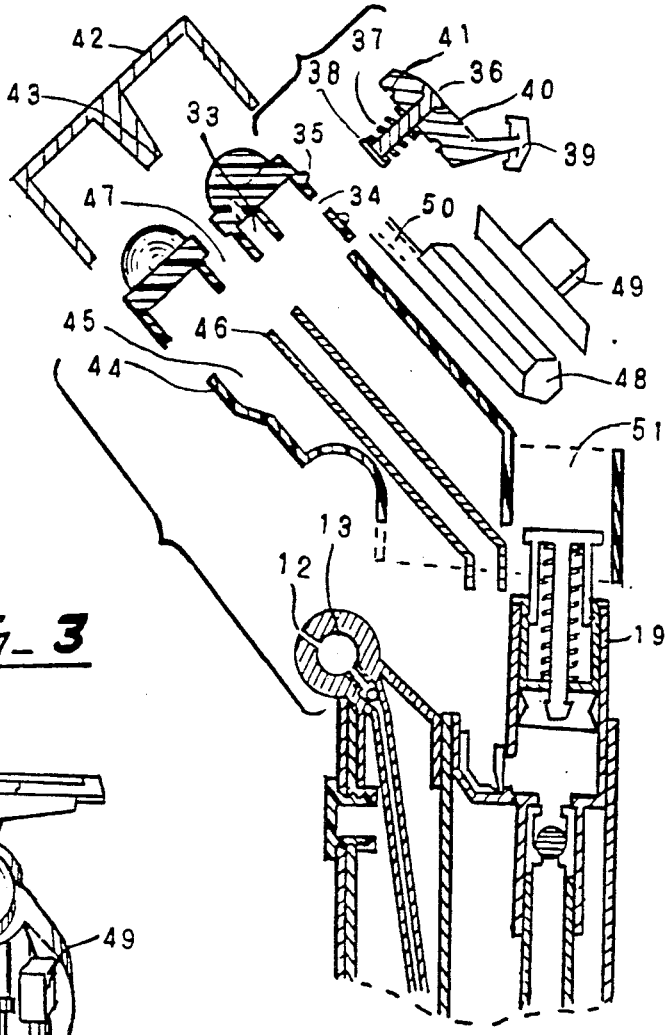
Fig. 3
Fig. 4
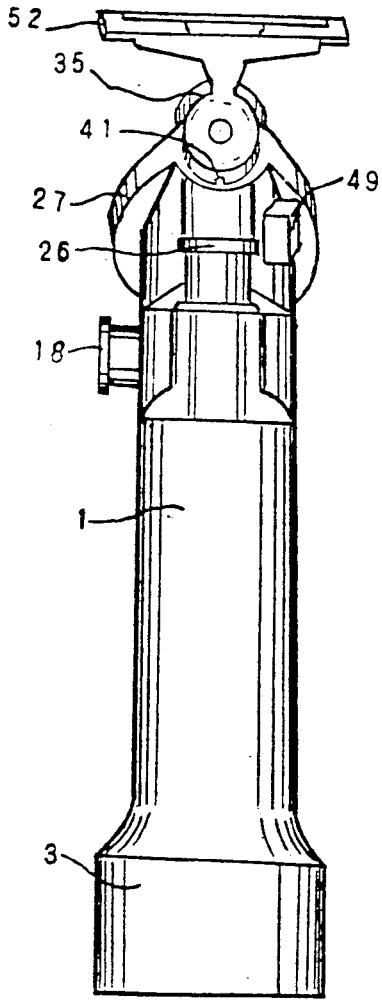
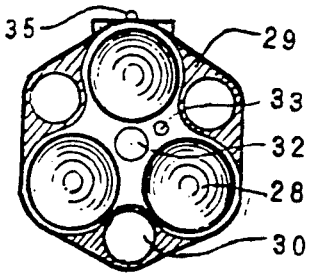
Fig. 5

SHAVING DEVICE

BACKGROUND OF THE INVENTION

The present invention generally relates to shaving devices.

Shaving devices of different types are known in the art. Usually, during the use of the shaving device with razor blades, first the user applies a shaving cream on the skin and distributes it over the skin, and then the shaving device with the razor is used to shave the hair. The known shaving devices possess several disadvantages. First of all, they are not used for applying and distributing the shaving cream on the skin. It is necessary to apply and distribute the shaving cream on the skin by an additional device or by hand which is inconvenient and unpleasant. The known shaving devices with razor blades do not massage the user's skin during shaving. Also, if the user wants to refresh and disinfect its skin with cologne, an additional device must be used. It is therefore desirable to improve the existing shaving devices.

SUMMARY OF THE INVENTION

Accordingly, it is an object of the present invention to provide a new and improved shaving device, which avoids the disadvantages of the prior art.

In keeping with these objects and with others which will become apparent hereinafter, one feature of the present invention resides, briefly stated, in a shaving device which has a hollow handle with an inner chamber, a head, means for supplying the shaving cream from the inner chamber of the handle through the head onto the user's skin, brush means for distributing the shaving cream on the user's hair and shaving means for shaving after the application of the shaving cream on the skin of the user.

When the shaving device is designed in accordance with the present invention it simultaneously applies and distributes the shaving cream and shaves the hair on the user's skin. When the shaving device is provided with additional refreshing substance storing and applying means, it refreshes and disinfects the skin after shaving has been completed. When the shaving device is provided with additional massaging means, it also massages the skin which further improves the quality of shaving. The inventive device is easy to wash, and convenient to use since it simultaneously performs several operations.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIG. 3 is a rear view of the device in accordance with the present invention;

FIG. 4 is a view illustrating a sequence of connection of parts of the inventive device;

FIG. 5 is a front view of a head of the inventive device without the brushes;

DESCRIPTION OF THE PREFERRED EMBODIMENTS

Figure 1:
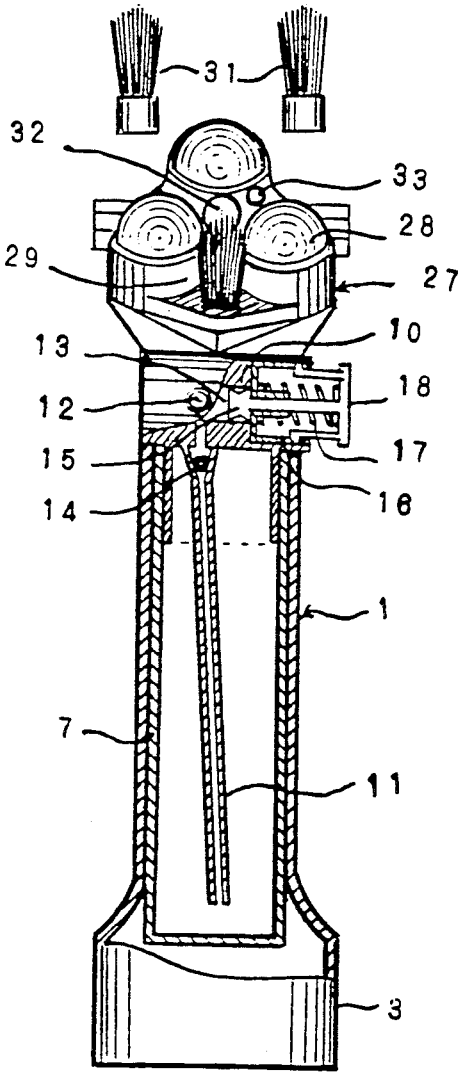
FIG. 1 is a front view of a new shaving device in accordance with the present invention.
Figure 2:
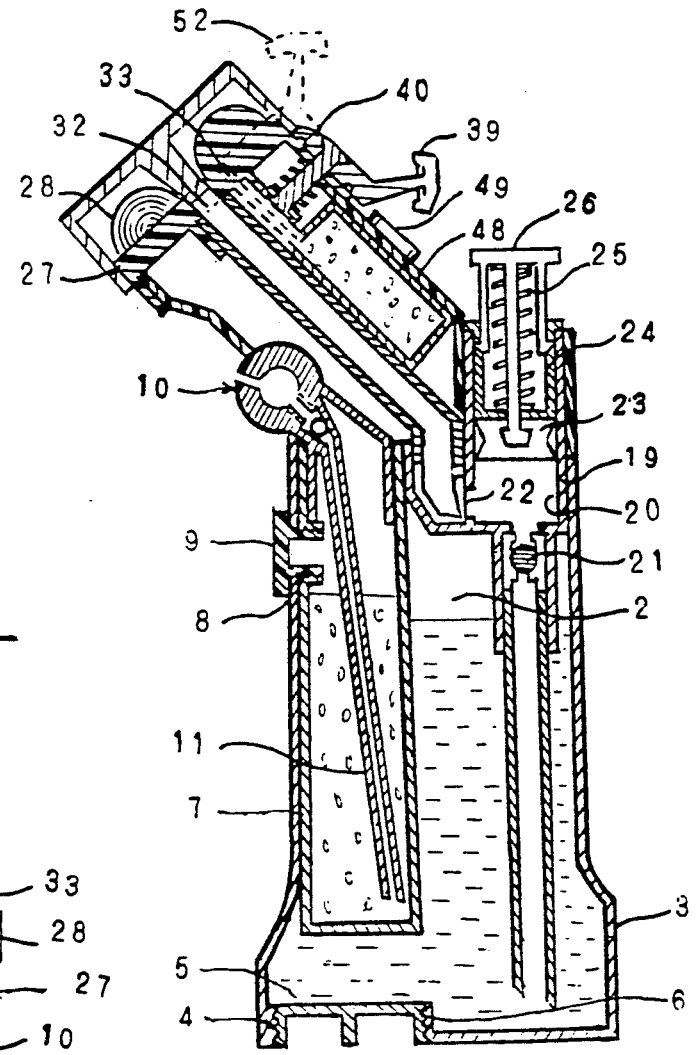
FIG. 2 is a side view of the device in accordance with the present invention.
Figure 6:
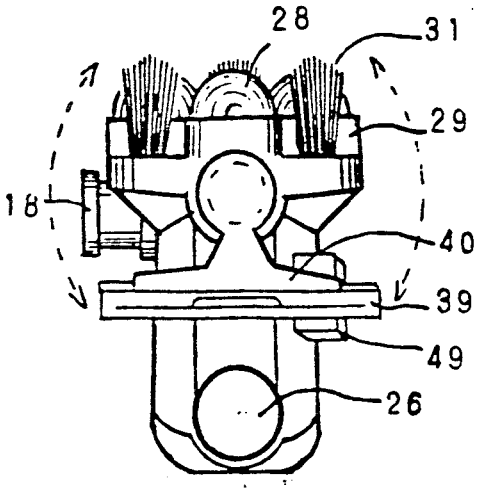
FIG. 6 is a top view of the device in accordance with the present invention.

A shaving device in accordance with the present invention has a handle which is identified as a whole with reference numeral 1. Handle 1 has an inner hollow 2 with a wider part 3 provided with an inner thread 4. The inner hollow is closeable by plug 5 provided with an outer thread 6 cooperating with the inner thread 4.

The handle 1 also has a narrow part of an oval cross-section. An additional reservoir 7 is inserted in the narrow part of the inner hollow 2 and filled with a refreshing substance, such as for example cologne through an opening 8. The opening 8 is closeable by a plug 9 which extends beyond the outer surface of the handle. It is also possible to use a valve for closing the opening 8.

The reservoir 7 is connected with an atomizer 10 by a pipe 11 extending into the reservoir. The atomizer 10 includes a pulverizer 12, valve member 14, cylinder 13, a piston 15, a cylinder 16, a spring 17 and a push button 18.

A pump is inserted in the top part and includes a housing 19, a cylinder 20, a spherical valve 21 and a slide flat valve 22, a piston 23, a cylinder 24, a spring 25 and a bush button 26.

A head 27 is mounted on the handle. The head is formed as a one-piece integral member, which is preferably composed from polished, heat-retaining material, such as for example aluminum alloy. The head 27 has three semi-spherical convex portions 28 and three depressions 29 between the convex portions. Three brushes 31 are inserted in openings 30 provided in the depressions. The head also has a central opening 32 for supplying shaving cream, and an opening 33 for supplying water. An opening 34 and two projections 35 are provided for fixing a shaving element in the neutral position and in the working position. The connection includes a ball 36, a spring 37 and a screw 38, while a shaving element 39 has a clamp 40 with projections 41.

A lid 42 is placed on the head in the neutral position. The lid has a projection 43 which closes the opening for supplying the shaving cream A central unit 44 is a connecting element between the head and the handle. It includes a shaped hollow 45 with an inlet pipe 46 centered by is part 51 for supplying the shaving cream. The inlet pipe 46 is inserted in an opening 47 provided in the head, on its bottom near the valve part of the pump. An elastic reservoir 48 is inserted in the top of the shaped hollow 46, and a push button is arranged in an opening in the body in the central unit. The reservoir is inserted by an opening 50 in the opening 33 of the head. The rear side of the central unit has an opening in which the pump housing 19 is inserted.

The device operates in the following manner:

First of all, the head is immersed into warm water for heating up the head. Simultaneously, the button 49 is depressed and the reservoir 48 is compressed. When the button 49 is released warm water is aspirated in the reservoir 48 to the opening 33. The push button 26 of the pump is pressed and the shaving cream is aspirated through the pipe 46 from the inner hollow of the handle in the center of the head and then exits through the central opening 32. The head is brought into contact with the user's skin, the shaving cream is expelled on the skin, and the head is moved along the skin. The brushes 31 uniformly distribute the shaving cream and produce a foam on the skin. If needed, additional water is supplied for producing the foam by depressing the button 49, so that water is aspirated outside from the reservoir 48 through the opening 33 and mixed with the shaving cream to make a foam.

The semi-spherical convex portion 28 warm the skin and make the additional massage. When the skin is covered by the foam, the user turns the shaving element 39 to a position 52 with the clamp 40 around about its axis by 180° and fixes the element by the projections 41. After shaving, the button 18 of the atomizer is pushed several times, and the cologne is distributed on the user's skin.

Figure 8:
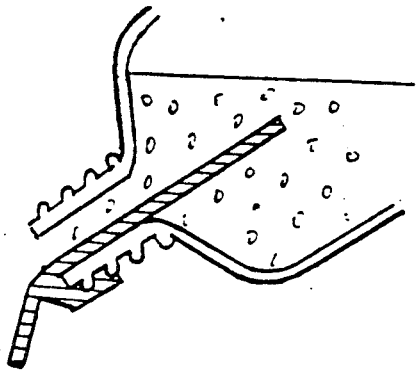
FIGS. 8-9 show a possible way of refilling a reservoir with cologne of the inventive device.
Figure 7:
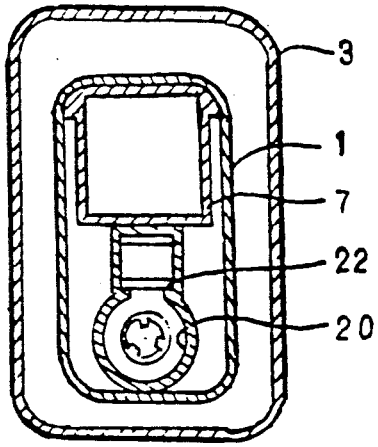
FIG. 7 is a top view of a handle of the inventive device.
Figure 9:
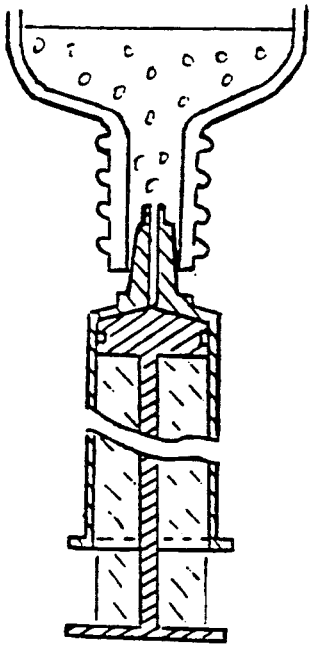

The refilling of the atomizer is performed as shown in FIGS. 8 and 9, and it is also possible to use the valve instead of pushing the button 18.

The invention is not limited to the details shown, since various modifications and structural changes are possible without departing in any way from the spirit of the What is desired to be protected by Letters Patent is set forth in the appended claims.

I claim:

1. A shaving device, comprising a handle having an inner chamber for accommodating a shaving cream; a head connected with said handle and having passage means for passing shaving cream supplied from said inner chamber of said handle through said head and outwardly of the latter; means for supplying shaving cream from said handle to said head and outwardly of the latter; brush means provided on said head for distributing the shaving cream discharged from said head over the skin of the user and including a plurality of brushes circumferentially spaced from one another; shaving means provided on said head for shaving after the application of shaving cream on the skin of a user; and means for massaging the skin of the user and including a plurality of convex portions protruding from said head and spaced circumferentially from one another so as to be located in alternating order with said brushes, said head with and said convex portions of said massaging means being formed as a one-piece integral element.

2. A shaving device as defined in claim 1, wherein said means for supplying shaving cream includes a pump provided in said handle and a button activating said pump to aspirate the shaving cream from said inner chamber of said handle and supplying the shaving cream to said head and outwardly on the user's skin.

3. A shaving device as defined in claim 1; sand further comprising means for aspirating water into said head and then expelling the water from said head outwardly on the user's skin.

4. A shaving device as defined in claim 3 wherein said means for aspirating water includes an elastic reservoir arranged in said head and a member actuatable by a user and acting on said elastic reservoir for compressing said elastic reservoir and releasing the same so as to aspirate water.

5. A shaving device as defined in claim 1, wherein said shaving means is turnable about an axis perpendicular to said head between a first retracted position in which it is retracted rearwardly head so that the shaving cream can be first applied on the user's skin and said brush means can distribute the shaving cr m on the user's skin, and a second position forwardly of said head for shaving the user's hair.

6. A shaving device as defined in claim 5; and further comprising means for fixing said shaving means in each of said positions.

7. A shaving device as defined in claim 1; and further comprising means for supplying a refreshing substance of the user's skin.

8. A shaving device as defined in claim 7, wherein said means for supplying a refreshing substance include a refreshing substance accommodating reservoir and means for delivering the refreshing substance from said reservoir to said head and expelling the same outwardly on the user's skin.

9. A shaving device as defined in claim 8, wherein said refreshing substance accommodating reservoir is arranged in said handle.

10. A shaving device as defined in claim 8, wherein said delivering means includes an atomizer communicating with said refreshing substance accommodating reservoir.

* * * * *